US011186087B2

(12) United States Patent
Kura et al.

(10) Patent No.: US 11,186,087 B2
(45) Date of Patent: Nov. 30, 2021

(54) LIQUID DISCHARGE HEAD

(71) Applicant: Brother Kogyo Kabushiki Kaisha, Nagoya (JP)

(72) Inventors: Keiji Kura, Chita (JP); Yasuhiro Sekiguchi, Nagoya (JP); Jiro Yamamoto, Nagoya (JP); Yoshitsugu Morita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/910,335

(22) Filed: Jun. 24, 2020

(65) Prior Publication Data

US 2021/0023843 A1 Jan. 28, 2021

(30) Foreign Application Priority Data

Jul. 26, 2019 (JP) ..... JP2019-137659

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ..... B41J 2/1433; B41J 2002/14419
See application file for complete search history.

(56) References Cited

U.S. PATENT DOCUMENTS

2017/0232749 A1 8/2017 Kanegae
2018/0250934 A1 9/2018 Shimoyama

FOREIGN PATENT DOCUMENTS

EP 3075537 A2 10/2016
JP 2006-082394 A 3/2006
JP 2012-106513 A 6/2012
JP 2016-030367 A 3/2016
JP 2017-196847 A 11/2017

OTHER PUBLICATIONS

Jan. 27, 2021—(EP) Extended EP Search Reprot—App 20181534.7.

*Primary Examiner* — Lamson D Nguyen
(74) *Attorney, Agent, or Firm* — Banner & Witcoff, Ltd.

(57) ABSTRACT

There is provided a liquid discharge head including a channel member including: a nozzle surface in which a plurality of first nozzles and second nozzles are opened; first and second common channels; and a film member including a first surface and a second surface. The second surface includes a first recess overlapping with the first common channel in the third direction, and a second recess overlapping with the second common channel in the third direction. A length of the first recess in the second direction is different from a length of the second recess in the second direction.

23 Claims, 9 Drawing Sheets

LIQUID DISCHARGE HEAD

CROSS REFERENCE TO RELATED APPLICATION

The present application claims priority from Japanese Patent Application No. 2019-137659, filed on Jul. 26, 2019, the disclosure of which is incorporated herein by reference in its entirety.

BACKGROUND

Field of the Invention

The present disclosure relates to a liquid discharge head having two or more common channels.

Description of the Related Art

In a known liquid discharge head, volumes of two common liquid chambers (common channels) to which two nozzle rows (nozzle arrays) are communicated, respectively, are made to be different from each other to thereby make the characteristic periods of the two common liquid chambers to be different from each other, thus suppressing any unevenness (non-uniformity) in density.

SUMMARY

In a case that the volumes of the two common liquid chambers (common channels) are made to be mutually different (different from each other) in order to make the characteristic periods of the two common liquid chambers to be mutually different as in the case of the above liquid discharge head, there is such a possibility that the following problems might occur.

For example, when making the volumes of the two common liquid chambers be mutually different, in a case that lengths in the height direction of the two common liquid chambers are made to be mutually different, then a length from a pressure chamber to a nozzle becomes long in an individual liquid chamber communicating with one of the two common liquid chambers of which length in the height direction is longer than the other of two common liquid chambers, and thus the driving period therefor cannot be made to be short, which in turn makes it hard to realize a high speed recording.

Further, for example, when making the volumes of the two common liquid chambers be mutually different, in a case that lengths in the width direction of the two common liquid chambers are made to be mutually different and that one of the two common liquid chambers is allowed to have a length in the width direction which is longer than a length in the width direction of the other of the two common liquid chambers, then the size of the liquid discharge head in the width direction becomes great. Alternatively, in a case that a length of one of the two common liquid chambers is allowed to have a length in the width direction which is shorter than a length in the width direction of the other of the two common liquid chambers, then the resistance in channel (channel resistance) in one of the two common liquid chambers becomes great, which in turn might cause the under-refilling phenomenon.

An object of the present disclosure is to provide a liquid discharge head which is capable of making the characteristic periods of the two common channels to be mutually different and of suppressing any non-uniformity in density, without changing the volumes of the two common channels to be mutually different.

According to a first aspect of the present disclosure, there is provided a liquid discharge head including: a channel member including: a nozzle surface in which a plurality of first nozzles aligned in a first direction, and a plurality of second nozzles aligned in the first direction and arranged side by side to the plurality of first nozzles in a second direction orthogonal to the first direction are opened; a first common channel extending in the first direction and communicating with the plurality of first nozzles; a second common channel extending in the first direction, arranged side by side to the first common channel in the second direction, and communicating with the plurality of second nozzles; and a film member including a first surface and a second surface, the first surface defining the first common channel and the second common channel, being parallel to the first and second directions, the second surface being located on an opposite side to the first surface in a third direction orthogonal to the first and second directions, and being parallel to the first and second directions. The second surface includes a first recess overlapping with the first common channel in the third direction, and a second recess overlapping with the second common channel in the third direction. A length of the first recess in the second direction is different from a length of the second recess in the second direction.

According to a second aspect of the present disclosure, there is provided a liquid discharge head including: a channel member including: a nozzle surface in which a plurality of first nozzles aligned in the first direction, and a plurality of second nozzles aligned in the first direction and arranged side by side to the plurality of first nozzles in a second direction orthogonal to the first direction are opened; a first common channel extending in the first direction and communicating with the plurality of first nozzles; a second common channel extending in the first direction, arranged side by side to the first common channel in the second direction, and communicating with the plurality of second nozzles; a first film defining the first common channel; and a second film defining the second common channel A length of the first common channel in the first direction is same as a length of the second common channel in the first direction. An elastic compliance of the first film is different from an elastic compliance of second film.

In the first aspect, the length in the second direction of the first recess and the length in the second direction of the second recess are different from each other. In the second aspect, the elastic compliance of the first film and the elastic compliance of the second film are different from each other. According to the first and second aspects, it is possible to make the characteristic periods of the first and second common channels to be different from each other by the above-described features, without changing the volumes of the first and second common channels to be different from each other. Consequently, it is possible to suppress any non-uniformity in density.

DESCRIPTION OF THE EMBODIMENTS

First Embodiment

Figure 1:
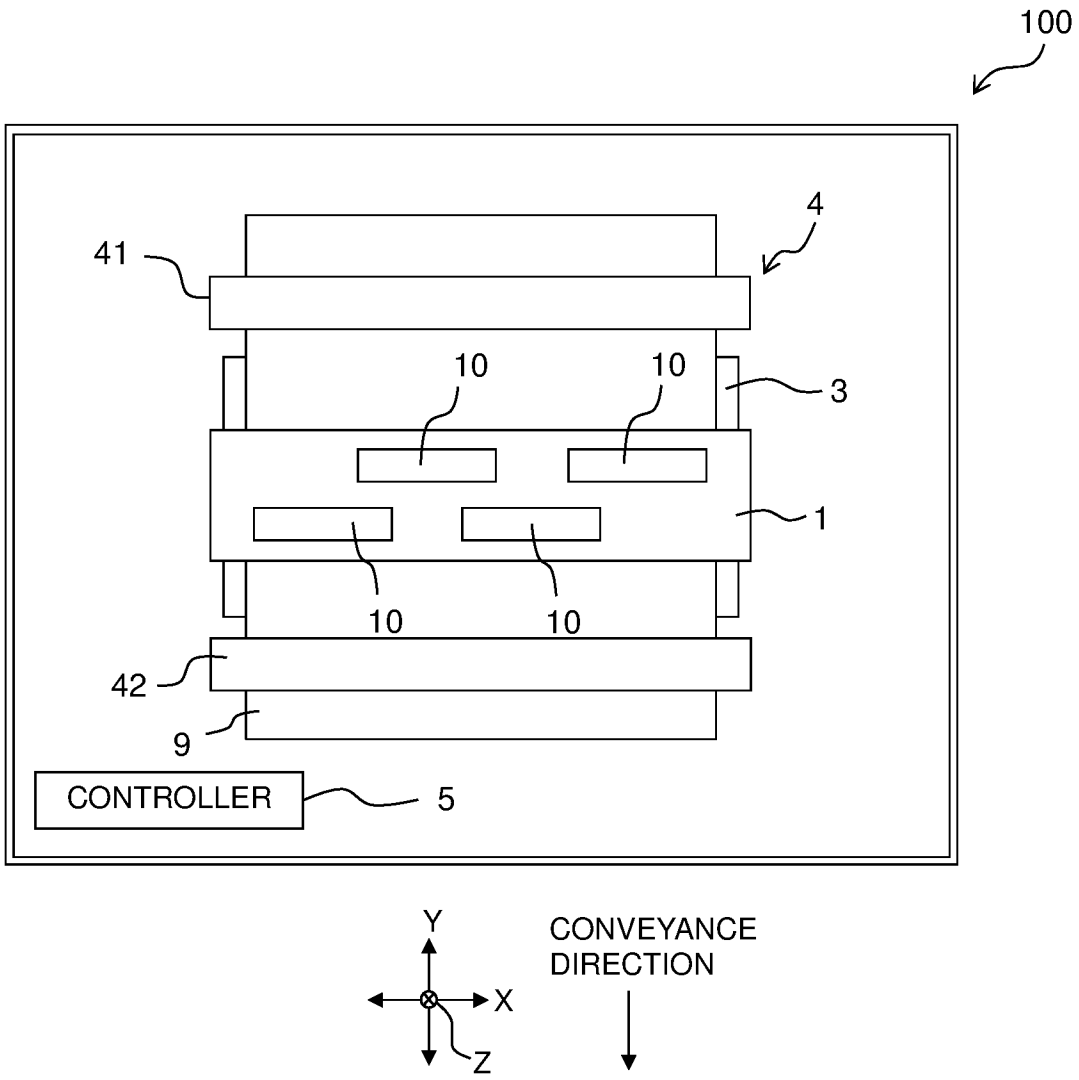
FIG. 1 is a plane view of a printer provided with a head according to a first embodiment of the present disclosure.

Firstly, the overall configuration of a printer 100, provided with a head 10 according to a first embodiment of the present disclosure, will be explained with reference to FIG. 1.

The printer 100 is provided with a head unit 1 including four heads 10, a platen 3, a conveying mechanism 4 and a controller 5.

In the following explanation, Z direction is the vertical direction, and X direction and Y direction are horizontal directions, respectively. The X direction and the Y direction are both orthogonal to the Z direction. The X direction is orthogonal to the Y direction. The X direction corresponds to "first direction", the Y direction corresponds to "second direction", and the Z direction corresponds to "third direction".

A paper sheet (paper) 9 is placed on the upper surface (one surface in the Z direction) of the platen 3.

The conveying mechanism 4 has two roller pairs 41 and 42 which are arranged with the platen 3 intervened therebetween in the Y direction. In a case that a conveying motor (of which illustration is omitted in the drawings) is driven by control of the controller 5, the roller pairs 41 and 42 rotate in a state that the paper sheet 9 is sandwiched or pinched therebetween, thereby conveying the paper sheet 9 in a conveyance direction along the Y direction.

The head unit 1 is elongated in the X direction, and the head unit 1 is of a line system wherein an ink is discharged with respect to the paper sheet 9 from nozzles 21 (see FIGS. 2 and 3) in a state that the position of the head unit 1 is fixed. The four heads 10 are arranged in a staggered manner in the X direction. Each of the four heads 10 corresponds to a "liquid discharge head" of the present disclosure.

The controller 5 has a ROM (Read Only Memory), a RAM (Random Access Memory) and an ASIC (Application Specific Integrated Circuit). The ASIC performs a recording processing, etc., in accordance with a program stored in the ROM. In the recording processing, the controller 5 controls a driver IC of each of the heads 10 and the conveyance motor (both of which are omitted in the illustration of the drawings), based on a recording instruction or recording command (including image data) inputted from an external apparatus or external device such as a PC, and performs recording of an image, etc., on the paper sheet 9.

Next, the configuration of each of the heads 10 will be explained with reference to FIGS. 2 to 4.

The head 1 has a channel member 11 and an actuator unit 12.

Figure 3:
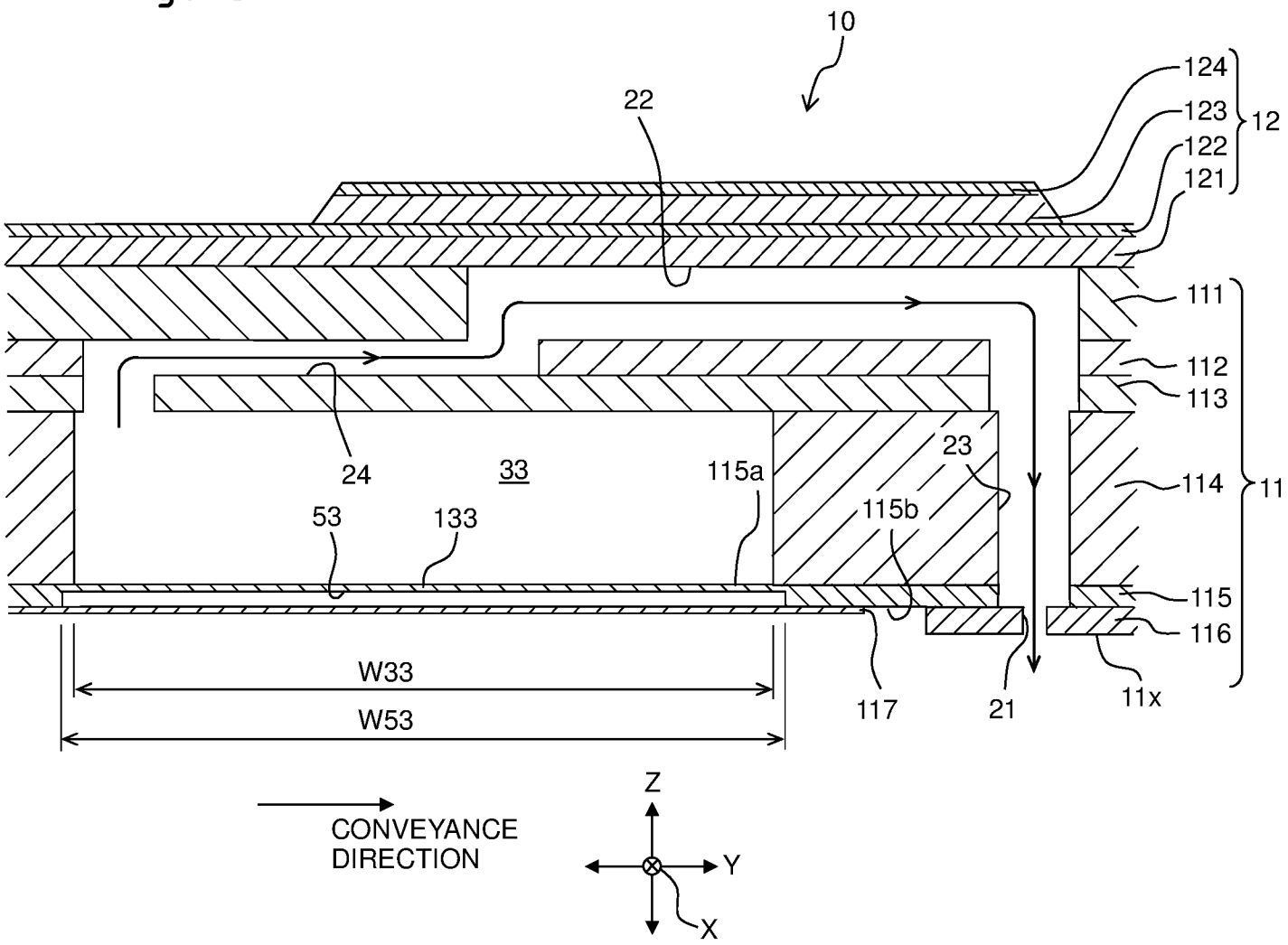
FIG. 3 is a cross-sectional view of the head, along a line in FIG. 2.
Figure 4:
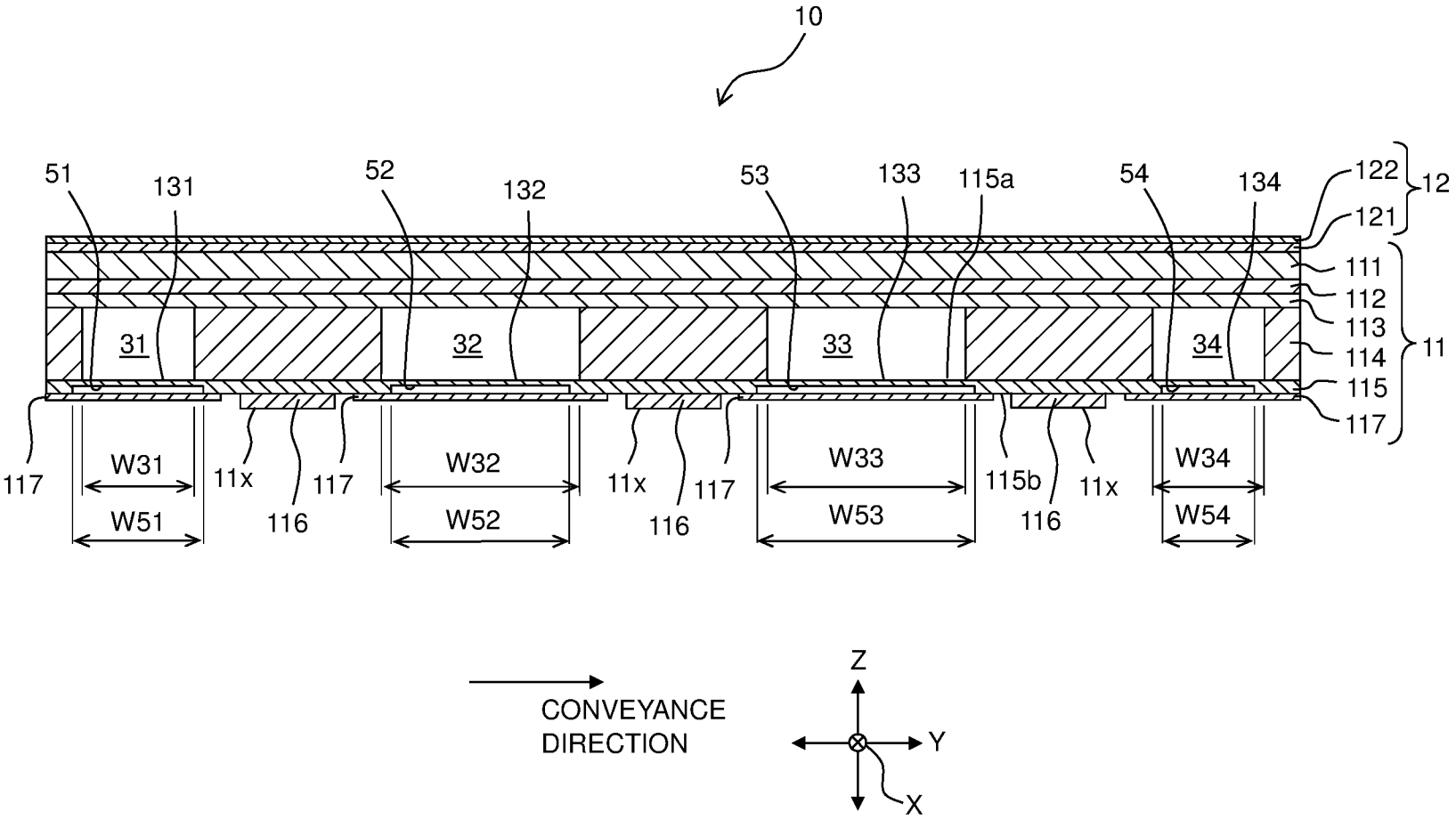
FIG. 4 is a cross-sectional view of the head, along a IV-IV line in FIG. 2.

As depicted in FIGS. 3 and 4, the channel member 11 has: 5 (five) plates 111 to 115 which are stacked in the Z direction; 3 (three) plates 116 which are arranged side by side in the Y direction and adhered to a lower surface 115*b* of the plate 115; and 4 (four) plates 117 which are arranged side by side in the Y direction and adhered to the lower surface 115*b* of the plate 115. The plate 115 is arranged on the lowermost side among the five plates 111 to 115.

The nozzles 21 are formed in each of the three plates 116. As depicted in FIG. 2, the nozzles 21 construct 6 (six) nozzle rows (nozzle arrays) R1 to R6 arranged side by side in the Y direction. Each of the nozzle rows R1 to R6 is constructed of 6 pieces of the nozzle 21 aligned in the X direction.

The nozzle rows R2 to R5 are positioned between the nozzle row R1 and the nozzle row R6 in the Y direction. The nozzle rows R3 and R4 are positioned between the nozzle row R2 and the nozzle row R5 in the Y direction. The nozzle row R4 is positioned between the nozzle row R3 and the nozzle row R5 in the Y direction.

A spacing distance S1 in the Y direction between the nozzle row R1 and the nozzle row R2, a spacing distance S1 in the Y direction between the nozzle row R3 and the nozzle row R4, and a spacing distance S1 in the Y direction between the nozzle row R5 and the nozzle row R6 are same as one another. A spacing distance S2 in the Y direction between the nozzle row R2 and the nozzle row R3, and a spacing distance S2 in the Y direction between the nozzle row R4 and the nozzle row R5 are same as each other. The spacing distance S1 is smaller than the spacing distance S2.

Figure 2:
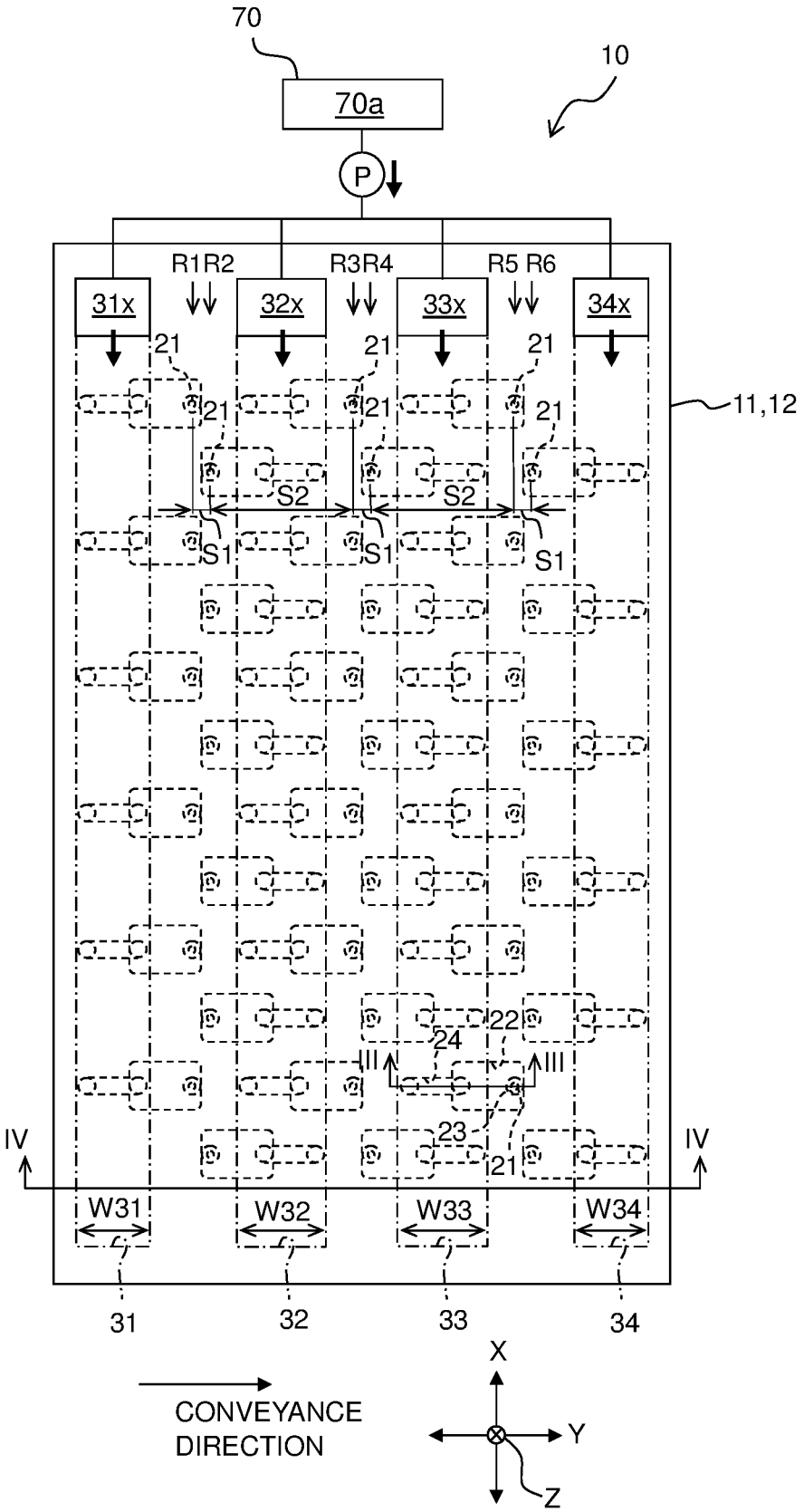
FIG. 2 is a plane view of the head.

A plate 116 which is included in the three plates 116 and which is located on the leftmost side among the three plates 116 in FIG. 4 (one end in the Y direction) is formed with 12 pieces of the nozzle 21 which belong to the nozzle rows R1 and R2 (see FIG. 2). A plate 116 which is included in the three plates 116 and which is located on the center in the Y direction in FIG. 4 is formed with 12 pieces of the nozzle 21 which belong to the nozzle rows R3 and R4 (see FIG. 2). A plate 116 which is included in the three plates 116 and which is located on the rightmost side among the three plates 116 in FIG. 4 (the other end in the Y direction) is formed with 12 pieces of the nozzle 21 which belong to the nozzle rows R5 and R6 (see FIG. 2).

The lower surface of each of the plates 116 corresponds to a nozzle surface 11*x*. The nozzle surface 11*x* is parallel to the X direction and the Y direction (namely, orthogonal to the Z direction).

As depicted in FIG. 4, four common channels 31 to 34 arranged side by side in the Y direction are formed in the plate 114. Each of the common channels 31 to 34 extends in the X direction, as depicted in FIG. 2.

The common channels 32 and 33 are located between the common channel 31 and the common channel 34 in the Y direction. The common channel 33 is located between the common channel 32 and the common channel 34 in the Y direction.

Lengths in the X direction of the four common channels 31 to 34 are same as one another, and lengths in the Z direction (depths) of the four common channels 31 to 34 are same as one another. Lengths in the Y direction (widths) W31 and W34 of the common channels 31 and 34 are same as each other, and the volumes of the common channels 31 and 34 are same as each other. Lengths in the Y direction (widths) W32 and W33 of the common channels 32 and 33 are same as each other, and the volumes of the common channels 33 and 33 are same as each other. The widths W32 and W33 are greater than the widths W31 and W34. Further, the widths W32 and W33 are greater than the spacing distance S1 and are smaller than the spacing distance S2.

The nozzle rows R1 and R2 are positioned between the common channels 31 and 32 in the Y direction. The nozzle rows R3 and R4 are positioned between the common channels 32 and 33 in the Y direction. The nozzle rows R5 and R6 are positioned between the common channels 33 and 34 in the Y direction.

The common channel 31 communicates with 6 pieces of the nozzle 21 constructing the nozzle row RE The common channel 32 communicates with 6 pieces of the nozzle 21 constructing the nozzle row R2, and 6 pieces of the nozzle 21 constructing the nozzle row R3. The common channel 33 communicates with 6 pieces of the nozzle 21 constructing the nozzle row R4, and 6 pieces of the nozzle 21 constructing the nozzle row R5. The common channel 34 communicates with 6 pieces of the nozzle 21 constructing the nozzle row R6.

Each of the four common channels 31 to 34 communicates with a storing chamber 70*a* of a cartridge 70 via one of openings 31*x* to 34*x* formed in one ends in the X direction of the four common channels 31 to 34, respectively. An ink (for example, a black ink) is stored in the storing chamber 70*a*. The storing chamber 70*a* corresponds to a "first storing chamber", and the ink corresponds to a "first liquid". A pump P is arranged between the openings 31*x* to 34*x* and the storing chamber 70*a*. In a case that the pump is driven by control performed by the controller 5 (see FIG. 1), the ink inside the storing chamber 70*a* is supplied to the four common channels 31 to 34.

As depicted in FIG. 3, a pressure chamber 22 is formed in the plate 111. The pressure chamber 22 is provided on each of the nozzles 21. As depicted in FIG. 2, the pressure chamber 22 has a substantially rectangular shape as seen from the Z direction, and a length in the Y direction of the pressure chamber 22 is longer than a length in the X direction of the pressure chamber 22.

As depicted in FIG. 3, an upper end part of a channel 23 connecting the pressure chamber 22 and the nozzle 21, and a channel 24 connecting the pressure chamber 22 and any one of the common channels 31 to 34 are formed in the plates 112 and 113. The channel 23 and the channel 24 are provided on each pressure chamber 22. The channel 23 extends from one end in the Y direction of the pressure chamber 22 toward a lower side in the Z direction. The channel 24 connects the other end in the Y direction of the pressure chamber 22 and the other end in the Y direction of any one of the common channels 31 to 34. One end in the Y direction of each of the common channels 31 to 34 is positioned between the other end in the Y direction of each of the common channels 31 to 34 and the channel 23 communicating with each one of the common channels 31 to 34.

In addition to the four common channels 31 to 34, a central part of the channel 23 is also formed in the plate 114.

A lower end part of the channel 23 is formed in the plate 115. The channel 23 is constructed of the through holes formed in the plates 112 to 115, respectively.

As depicted in FIG. 4, four recesses 51 to 54 are further formed in the plate 115. The plate 115 has a flat upper surface 115*a* and a lower surface 115*b* having the four recesses 51 to 54 formed therein. The four recesses 51 and 54 are formed, for example, by half-etching.

The plate 115 corresponds to a "film member", and the upper surface 115*a* corresponds to a "first surface", and the lower surface 115*b* corresponds to a "lower surface". The upper surface 115*a* defines the common channels 31 to 34, and is parallel to the X direction and the Y direction (namely, orthogonal to the Z direction). The lower surface 115*b* is a side on an opposite side to the upper surface 115*a* in the Z direction, and is parallel to the X direction and the Y direction (namely, orthogonal to the Z direction).

The four recesses 51 to 54 overlap with the four common channels 34 to 34, respectively, in the Z direction.

Lengths in the X direction of the four recesses 51 to 54 are same as one another. The lengths in the X direction of the four recesses 51 to 54 are same as the lengths in the X direction of the four common channels 31 to 34. The four recesses 51 to 54 overlap, in the Z direction, with the entire areas in the X direction of the four common channels 31 to 34, respectively.

Lengths in the Z direction (depths) of the four recesses 51 to 54 are same as one another. Namely, films 131 to 134 constructing the bottoms of the recesses 51 and 54, respectively, in the plate 115, have lengths in the Z direction (thicknesses) which are same as one another.

The four recesses 51 to 54 have lengths in the Y direction (widths) W51 to W54 which are different from one another.

The width W51 is greater than the width W31. The width W54 is smaller than the width W34. Since the widths W31 and W34 are same as each other, the width W51 is greater than the width W54. The recess 51 projects to the both sides in the Y direction with respect to the common channel 31, and has an overlapping part which overlaps with the common channel 31 in the Z direction and a non-overlapping part which does not overlap with the common channel 31 in the Z direction. The entirety of the recess 54 overlaps with the common channel 34 in the Z direction, and thus does not have any part which does not overlap with the common channel 34 in the Z direction.

The width W53 is greater than the width W33. The width W52 is smaller than the width W32. Since the widths W32 and W33 are same as each other, the width W53 is greater than the width W52. The recess 53 projects to the both sides in the Y direction with respect to the common channel 33, and has an overlapping part which overlaps with the common channel 33 in the Z direction and a non-overlapping part which does not overlap with the common channel 33 in the Z direction. The entirety of the recess 52 overlaps with the common channel 32 in the Z direction, and thus does not have any part which does not overlap with the common channel 32 in the Z direction.

The films 131 to 134 are parts which define the common channels 31 to 34 in the bottoms of the recesses 51 to 54, respectively, and are located at areas or regions in which the recesses 51 to 54 overlap with the common channels 31 to 34, respectively, in the Z direction. Accordingly, a length in the Y direction (width) of the film 131 is same as the width W31 of the common channel 31. A length in the Y direction (width) of the film 134 is same as the width W54 of the recess 54. A length in the Y direction (width) of the film 132 is same as the width W52 of the recess 52. A length in the Y direction (width) of the film 133 is same as the width W33 of the common channel 33.

The length in the Y direction (=width W31) of the film 131 is greater than the length in the Y direction (=width W54) of the film 134. The length in the Y direction (=width W33) of the film 133 is greater than the length in the Y direction (=width W52) of the film 132.

The four plates 117 are adhered to the lower surface 115*b* of the plate 115 so that the four plates 117 cover the four recesses 51 to 54, respectively. With this, the films 131 to 134 are not exposed, and spaces are defined between the respective films 131 to 134 and the respective plates 117, respectively.

As depicted in FIG. 3, the actuator unit 12 is arranged on the upper surface of the channel member 11 (the upper surface of the plate 111).

The actuator unit 12 includes, in an order from the lower side thereof, a vibration plate 121, a common electrode 122, a plurality of piezoelectric bodies 123 and a plurality of individual electrodes 124. The vibration plate 121 and the common electrode 122 are arranged on substantially the entirety of the upper surface of the channel member 11, and cover all the pressure chambers 22 formed in the channel member 11. On the other hand, each of the plurality of piezoelectric bodies 123 and each of the plurality of individual electrodes 124 are provided with respect to one of the pressure chambers 22, and overlap with one of the pressure chambers 22 in the Z direction.

The vibration plate 121 is formed, for example, of a metal material such as stainless steel, etc., a piezoelectric material which contains titanate zirconate as a main component thereof, a synthetic resin material, etc. Each of the piezoelectric bodies 123 is formed of a piezoelectric material which contains titanate zirconate as a main component thereof.

The plurality of individual electrodes 124 and the common electrode 122 are electrically connected to a driver IC (omitted in the drawings). The driver IC maintains the potential of the common electrode 122 at the ground potential, whereas the potential of each of the plurality of individual electrodes 124 are changed. Specifically, the driver IC generates a driving signal based on a control signal from the controller 5, and applies the driving signal to each of the plurality of individual electrodes 124. By doing so, the potential of each of the plurality of individual electrodes 124 is changed between a predetermined driving potential and the ground potential. In this situation, parts or portions in the vibration plate 121 and one of the plurality of piezoelectric bodies 123, respectively, which are sandwiched between each of the plurality of individual electrodes 124 and one of the pressure chambers 22 corresponding thereto are deformed so as to project toward one of the pressure chambers 22. With this, the volume of one of the pressure chambers 22 is changed, which in turn applies the pressure to the ink inside one of the pressure chambers 22. The ink passes through the channel 23 and is discharged from the nozzle 21 corresponding to one of the pressure chambers 22. At the same time, the ink inside one of the common channels 31 to 34 flows the channel 24 and is supplied to one of the pressure chambers 22.

For example, in the present embodiment, the common channel 32 corresponds to a "first common channel", the common channel 33 corresponds to a "second common channel", the nozzles 21 constructing the nozzle rows R2 and R3 correspond to "first nozzles", the nozzles 21 constructing the nozzle rows R4 and R5 correspond to "second nozzles", the nozzle row R2 corresponds to a "first nozzle row", the nozzle row R3 corresponds to a "second nozzle row", the nozzle row R4 corresponds to a "third nozzle row", the nozzle row R5 corresponds to a "fourth nozzle row", the film 132 corresponds to a "first film", the film 133 corresponds to a "second film", the recess 52 corresponds to a "first recess", and the recess 53 corresponds to a "second recess". Here, in a case that the compliance of the film 132 and the compliance of the film 133 are compared, although the lengths in the X direction and the lengths in the Z direction of the film 132 as same as those of the film 133, respectively, the length in the Y direction (=width W52) of the film 132 is smaller than the length in the Y direction (=width W33) of the film 133, thus the compliance of the film 132 is smaller than the compliance of the film 133.

According to the present embodiment, the length W52 in the Y direction of the recess 52 and the length W53 in the Y direction of the recess 53 are different from each other (see FIG. 4). The compliance of the film 132 and the compliance of the film 133 are different from each other. With this, it is possible to make the characteristic periods of the common channels 32 and 33 to be different from each other, without making the volumes of the common channels 32 and 33 to be different from each other; consequently, it is possible to suppress any non-uniformity in the density.

Further, for example, in the present embodiment, the common channel 34 corresponds to the "first common channel", the common channel 31 corresponds to the "second common channel", the nozzles 21 constructing the nozzle row R6 correspond to the "first nozzles", the nozzles 21 constructing the nozzle row R1 correspond to the "second nozzles", the film 134 corresponds to the "first film", the film 131 corresponds to the "second film", the recess 54 corresponds to the "first recess", and the recess 51 corresponds to the "second recess". Here, in a case that the compliance of the film 131 and the compliance of the film 134 are compared, although the lengths in the X direction and the lengths in the Z direction of the film 131 are same as those of the film 134, respectively, the length in the Y direction (=width W54) of the film 134 is smaller than the length in the Y direction (=width W31) of the film 131, thus the compliance of the film 134 is smaller than the compliance of the film 131.

According to the present embodiment, the length W54 in the Y direction of the recess 54 and the length W51 in the Y direction of the recess 51 are different from each other (see FIG. 4). The compliance of the film 134 and the compliance of the film 131 are different from each other. With this, it is possible to make the characteristic periods of the common channels 34 and 31 to be different from each other, without making the volumes of the common channels 34 and 31 to be different from each other; consequently, it is possible to suppress any non-uniformity in the density.

The length in the Y direction (width) W52 of the recess 52 and the length in the Y direction (width) W53 of the recess 53 are different from each other (see FIG. 4). In this situation, in a case that the compliance of the film 132 and the compliance of the film 133 are made to be different from each other, the production or manufacture thereof is easier and it is possible to suppress any increase in the number of parts, components, etc., as compared with another case wherein the lengths (depths) in the Z direction of the recesses 52 and 53 are made to be different from each other. Specifically, in another case wherein the depths of the recesses 52 and 53 are made to be different from each other, it might be necessary to adjust the depth of the etching and/or to increase the number of parts, components, etc., which construct the film member. In contrast, in the case of making the width W52 of the recess 52 and the width W53 of the recess 53 to be different from each other, as in the present embodiment, it is sufficient to adjust only the width of the etching, which is easier as compared with another case of adjusting the depth of etching, and there is also no need to increase the number of the parts, components, etc.

The length in the Y direction (width) W54 of the recess 54 and the length in the Y direction (width) W51 of the recess 51 are different from each other (see FIG. 4). In this situation, in a case that the compliance of the film 134 and the compliance of the film 131 are made to be different from each other, the production or manufacture thereof is easier and it is possible to suppress any increase in the number of parts, components, etc., as compared with another case wherein the lengths in the Z direction (depths) of the recesses 54 and 51 are made to be different from each other.

Specifically, in another case wherein the depths of the recesses 54 and 51 are made to be different from each other, it might be necessary to adjust the depth of the etching and/or to increase the number of parts, components, etc., which construct the film member. In contrast, in the case of making the width W54 of the recess 54 and the width W51 of the recess 51 to be different from each other, as in the present embodiment, it is sufficient to adjust only the width of the etching, which is easier as compared with another case of adjusting the depth of etching, and there is also no need to increase the number of the parts, components, etc.

The length in the X direction of the common channel 32 and the length in the X direction of the common channel 33 are same as each other (see FIG. 2). In a case that the length in the X direction of one of the common channels 32 and 33 is made to be longer than the length in the X direction of the other of the common channels 32 and 33, then the size of the head 10 becomes to be great in the X direction. In contrast, in the present embodiment, the lengths in the X direction of the common channels 32 and 33 are made to be same as each other, thereby making it possible to suppress any increase in the size of the head 10 in the X direction.

The length in the X direction of the common channel 34 and the length in the X direction of the common channel 31 are same as each other (see FIG. 2). In a case that the length in the X direction of one of the common channels 34 and 31 is made to be longer than the length in the X direction of the other of the common channels 34 and 31, then the size of the head 10 becomes to be great in the X direction. In contrast, in the present embodiment, the lengths in the X direction of the common channels 34 and 31 are made to be same as each other, thereby making it possible to suppress any increase in the size of the head 10 in the X direction.

The length W53 in the Y direction of the recess 53 is longer than the length W52 in the Y direction of the recess 52, and is longer than the length W33 in the Y direction of the common channel 33 (see FIG. 4). In this case, even if any positional deviation in the Y direction occurred in the plate 115, it is possible to secure an area at which the recess 53 and the common channel 33 overlap with each other. Accordingly, it is possible to obtain a desired characteristic period with respect to the common channel 33, in an ensured manner.

The length W51 in the Y direction of the recess 51 is longer than the length W54 in the Y direction of the recess 54, and is longer than the length W31 in the Y direction of the common channel 31 (see FIG. 4). In this case, even if any positional deviation in the Y direction occurred in the plate 115, it is possible to secure an area at which the recess 51 and the common channel 31 overlap with each other. Accordingly, it is possible to obtain a desired characteristic period with respect to the common channel 31, in an ensured manner.

The length in the Y direction (=width W52) of the film 132 and the length in the Y direction (=width W33) of the film 133 are different from each other (see FIG. 4). In this case, the production or manufacture thereof is easier and it is also possible to suppress any increase in the number of parts, components, etc., as compared with another case wherein the lengths in the Z direction (thicknesses) of the films 132 and 133 are made to be different from each other. Specifically, in another case wherein the thicknesses of the films 132 and 133 are made to be different from each other, it might be necessary to adjust the depth of the etching and/or to increase the number of parts, components, etc., which construct the film 132 and 133. In contrast, in the case of making the length in the Y direction (width) of the film 132 and the length in the Y direction (width) of the film 133 to be different from each other, as in the present embodiment, it is sufficient to adjust only the width of the etching, which is easier as compared with another case of adjusting the depth of etching, and there is also no need to increase the number of the parts, components, etc.

The length in the Y direction (=width W54) of the film 134 and the length in the Y direction (=width W31) of the film 131 are different from each other (see FIG. 4). In this case, the production or manufacture thereof is easier and it is possible to suppress any increase in the number of parts, components, etc., as compared with another case wherein the lengths in the Z direction (thicknesses) of the films 134 and 131 are made to be different from each other. Specifically, in another case wherein the thicknesses of the films 134 and 131 are made to be different from each other, it might be necessary to adjust the depth of the etching and/or to increase the number of parts, components, etc., which construct the films 134 and 131. In contrast, in the case of making the length in the Y direction (width) of the film 132 and the length in the Y direction (width) of the film 133 to be different from each other, as in the present embodiment, it is sufficient to adjust only the width of the etching, which is easier as compared with another case of adjusting the depth of etching, and there is also no need to increase the number of the parts, components, etc.

The length W32 in the Y direction of the common channel 32 and the length W33 in the Y direction of the common channel 33 are same as each other (see FIG. 2). In a case that the length in the Y direction of one of the common channels 32 and 33 is made to be longer than the length in the Y direction of the other of the common channels 32 and 33, then the size of the head 10 becomes to be great in the Y direction. Alternatively, in a case that the length in the Y direction of one of the common channels 32 and 33 is made to be shorter than the length in the Y direction of the other of the common channels 32 and 33, then the channel resistance in one of the common channels 32 and 33 becomes greater, which in turn might cause the under-refilling phenomenon. In contrast, in the present embodiment, the lengths in the Y direction of the common channels 32 and 33 are made to be same as each other, thereby making it possible to suppress any increase in the size of the head 10 in the Y direction, and to suppress the under-refilling phenomenon.

The length W34 in the Y direction of the common channel 34 and the length W31 in the Y direction of the common channel 31 are same as each other (see FIG. 2). In a case that the length in the Y direction of one of the common channels 34 and 31 is made to be longer than the length in the Y direction of the other of the common channels 34 and 31, then the size of the head 10 becomes to be great in the Y direction. Alternatively, in a case that the length in the Y direction of one of the common channels 34 and 31 is made to be shorter than the length in the Y direction of the other of the common channels 34 and 31, then the channel resistance in one of the common channels 34 and 31 becomes greater, which in turn might cause the under-refilling phenomenon. In contrast, in the present embodiment, the lengths in the Y direction of the common channels 34 and 31 are made to be same as each other, thereby making it possible to suppress any increase in the size of the head 10 in the Y direction, and to suppress the under-refilling phenomenon.

The length in the Z direction of the common channel 32 and the length in the Z direction of the common channel 33 are made to be same as each other (see FIG. 4). In a case that the length in the Z direction of the common channel 32 and the length in the Z direction of the common channel 33 are made to be different from each other, then in a pressure chamber 22 communicating with one of the common channels 32 and 33 of which length in the Z direction is longer, the length from the pressure chamber 22 up to the nozzle 21 becomes long, which in turn makes it impossible to make the driving period to be short. Thus, it is hard to realize the high speed recording. In contrast, in the present embodiment, the lengths in the Z direction of the common channels 32 and 33 are made to be same as each other, thereby making it possible to suppress any increase in the length from the pressure chamber 22 up to the nozzle 21, and thus to make the driving period to be short, and consequently to realize the high speed recording.

The length in the Z direction of the common channel 34 and the length in the Z direction of the common channel 31 are made to be same as each other (see FIG. 4). In a case that the length in the Z direction of the common channel 34 and the length in the Z direction of the common channel 31 are made to be different from each other, then in a pressure chamber 22 communicating with one of the common channels 34 and 31 of which length in the Z direction is longer, the length from the pressure chamber 22 up to the nozzle 21 becomes long, which in turn makes it impossible to make the driving period to be short. Thus, it is hard to realize the high speed recording. In contrast, in the present embodiment, the lengths in the Z direction of the common channels 34 and 31 are made to be same as each other, thereby making it possible to suppress any increase in the length from the pressure chamber 22 up to the nozzle 21, and thus to make the driving period to be short, and consequently to realize the high speed recording.

In the Y direction, the six pieces of the nozzle 21 constructing the nozzle row R3 and the six pieces the nozzle 21 constructing the nozzle row R4 are arranged between the common channel 32 and the common channel 33 (see FIG. 2). In this case, the spacing distance in the Y direction between the nozzles 21 constructing the nozzle row R3 and the nozzles 21 constructing the nozzle row R4 becomes short, which in turn generally makes discharge timing of the nozzles 21 constructing the nozzle row R3 and discharge timing of the nozzles 21 constructing the nozzle row R4 to be same as each other (or close to each other). In this case, if the characteristic periods of the common channels 32 and 33 were same to each other, there is such a possibility that the ink discharged from the nozzles 21 constructing the nozzle row R3 and the ink discharged from the nozzles 21 constructing the nozzle rows R4 might be affected by the resonance in the common channels 32 and 33 at the same time, and/or that the resonance in the common channels 32 and 33 might make the crosstalk between the nozzles 21 constructing the nozzle row R3 and the nozzles 21 constructing the nozzle row R4 to be conspicuous, in some cases, which in turn might make any unevenness (non-uniformity) in density to be conspicuous. Further, the unevenness (non-uniformity) in density might be conspicuous also due to such a situation or case that a position at which the amount of the ink discharged from the nozzles 21 constructing the nozzle row R3 communicating with the common channel 32 is increased and at which the density becomes high, and a position at which the amount of the ink discharged from the nozzles 21 constructing the nozzle row R4 communicating with the common channel 33 is increased and at which the density becomes high are close to each other. By applying the present disclosure to such a case, it is possible to suppress the occurrence of the above-described problem(s), and to obtain the effects of the present disclosure effectively and practically.

The spacing distance S1 in the Y direction between the nozzle row R3 and the nozzle row R4 is smaller than any one of the spacing distance S2 in the Y direction between the nozzle row R2 and the nozzle row R3 and the spacing distance S2 in the Y direction between the nozzle row R4 and the nozzle row R5 (see FIG. 2). In this case, the spacing distance in the Y direction between the nozzles 21 constructing the nozzle row R3 and the nozzles 21 constructing the nozzle row R4 becomes short, which in turn generally makes discharge timing of the nozzles 21 constructing the nozzle row R3 and discharge timing of the nozzles 21 constructing the nozzle row R4 to be same as each other (or close to each other). In this case, if the characteristic periods of the common channels 32 and 33 were same to each other, there is such a possibility that the ink discharged from the nozzles 21 constructing the nozzle row R3 and the ink discharged from the nozzles 21 constructing the nozzle rows R4 might be affected by the resonance in the common channels 32 and 33 at the same time, and/or that the resonance in the common channels 32 and 33 might make the crosstalk between the nozzles 21 constructing the nozzle row R3 and the nozzles 21 constructing the nozzle row R4 to be conspicuous, in some cases, which in turn might make any unevenness (non-uniformity) in density to be conspicuous. Further, the unevenness (non-uniformity) in density might be conspicuous also due to such a situation or case that a position at which the amount of the ink discharged from the nozzles 21 constructing the nozzle row R3 communicating with the common channel 32 is increased and at which the density becomes high, and a position at which the amount of the ink discharged from the nozzles 21 constructing the nozzle row R4 communicating with the common channel 33 is increased and at which the density becomes high are close to each other. By applying the present disclosure to such a case, it is possible to suppress the occurrence of the above-described problem(s), and to obtain the effects of the present disclosure effectively and practically.

The common channels 32 and 33 communicate with the same storing chamber 70*a* (see FIG. 2). In this configuration, the kind of the liquid to be discharged is same between the nozzles 21 communicating with the common channel 32 and the nozzles 21 communicating with the common channel 33. In this case, if the characteristic periods of the common channels 32 and 33 are same as each other, the unevenness (non-uniformity) in density might be conspicuous. By applying the present disclosure to such a case, it is possible to obtain the effect of the present disclosure (effect of suppressing the unevenness in the density) effectively and practically.

The common channels 34 and 31 communicate with the same storing chamber 70*a* (see FIG. 2). In this configuration, the kind of the liquid to be discharged is same between the nozzles 21 communicating with the common channel 34 and the nozzles 21 communicating with the common channel 31. In this case, if the characteristic periods of the common channels 34 and 31 are same as each other, the unevenness (non-uniformity) in density might be conspicuous. By applying the present disclosure to such a case, it is possible to obtain the effect of the present disclosure (effect of suppressing the unevenness in the density) effectively and practically.

Second Embodiment

Figure 5:
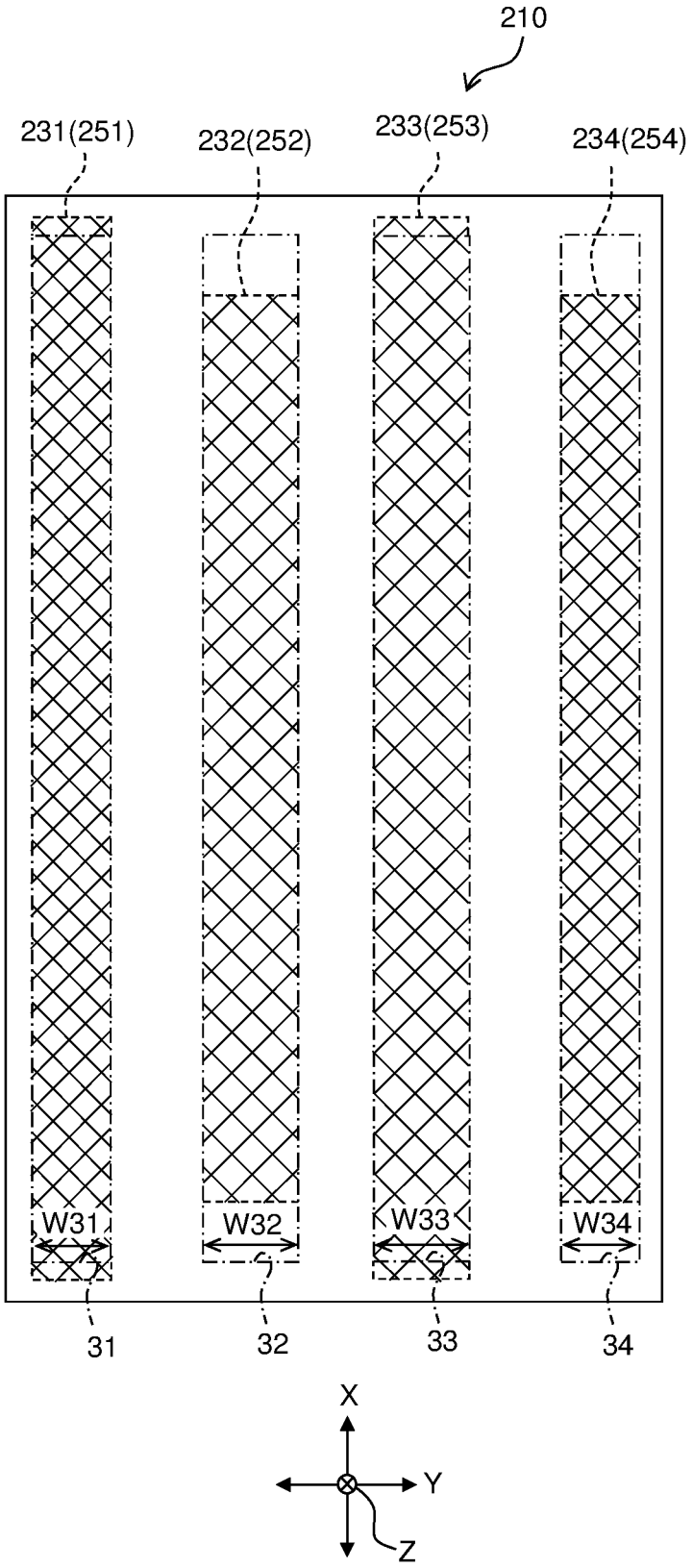
FIG. 5 is a plane view of a head according to a second embodiment, corresponding to FIG. 2.

Next, a head 210 according to a second embodiment of the present disclosure will be explained, with reference to FIG. 5.

In the first embodiment, the films 131 to 134 (recesses 51 to 54) have the lengths in the X direction which are same as one another. In contrast, in the second embodiment, length in the X direction of a film 232 (recess 252) and length in the X direction of a film 233 (recess 253) are different from each other; and length in the X direction of a film 234 (recess 254) and length in the X direction of a film 231 (recess 251) are different from each other.

Lengths in Y direction of the films 232 and 233 (recesses 252 and 253) are same as each other, and lengths in Y direction of the films 234 and 231 (recesses 254 and 251) are same as each other. The length in the Y direction of the film 232 (recess 252) is equal to the width W32 of the common channel 32. The length in the Y direction of the film 233 (recess 253) is equal to the width W33 of the common channel 33 (W32=W33). The length in the Y direction of the film 234 (recess 254) is equal to the width W34 of the common channel 34. The length in the Y direction of the film 231 (recess 251) is equal to the width W31 of the common channel 31 (W31=W34).

The lengths in the X direction of the films 231 and 233 (recesses 251 and 253) are longer than the lengths in the X direction of the common channels 31 and 33, respectively. Each of the films 231 and 233 (recesses 251 and 253) projects to the both sides in the X direction with respect to one of the common channels 31 and 33, and has an overlapping part which overlaps with one of the common channels 31 and 33 in the Z direction and a non-overlapping part which does not overlap with one of the common channels 31 and 33 in the Z direction.

The lengths in the X direction of the films 232 and 234 (recesses 252 and 254) are shorter than the lengths in the X direction of the common channels 32 and 34, respectively. The entireties of the films 232 and 234 (recesses 252 and 254) overlap with the common channels 32 and 34, respectively, in the Z direction, and thus do not have any parts which do not overlap with the common channel 32 and 34, respectively, in the Z direction.

For example, in the second embodiment, the recess 252 corresponds to a "first recess", and the recess 253 corresponds to a "second recess". The length in the X direction of the recess 253 is longer than the length in the X direction of the recess 252, and is longer than the length in the X direction of the common channel 33 (see FIG. 4). In this case, even if any positional deviation in the X direction occurred in the plate 115 (see FIG. 4), it is possible to secure an area at which the recess 253 and the common channel 33 overlap with each other. Accordingly, it is possible to obtain a desired characteristic period with respect to the common channel 33, in an ensured manner.

For example, in the second embodiment, the recess 254 corresponds to the "first recess", and the recess 251 corresponds to the "second recess". The length in the X direction of the recess 251 is longer than the length in the X direction of the recess 254, and is longer than the length in the X direction of the common channel 31 (see FIG. 4). In this case, even if any positional deviation in the X direction occurred in the plate 115 (see FIG. 4), it is possible to secure an area at which the recess 251 and the common channel 31 overlap with each other. Accordingly, it is possible to obtain a desired characteristic period with respect to the common channel 31, in an ensured manner.

For example, in the second embodiment, the film 232 corresponds to a "first film", and the film 233 corresponds to a "second film". Here, in a case that the compliance of the film 232 and the compliance of the film 233 are compared, although the lengths in the Y direction and the lengths in the Z direction of the film 232 are same as those of the film 233, respectively, the length in the X direction of the film 232 is smaller than the length in the X direction of the film 233, thus the compliance of the film 232 is smaller than the compliance of the film 233.

According to the second embodiment, in a case that the compliance of the film 232 and the compliance of the film 233 are made to be different from each other, the production or manufacture thereof is easier and it is possible to suppress any increase in the number of parts, components, etc., as compared with another case wherein the lengths in the Z direction (thicknesses) of the films 232 and 233 are made to be different from each other. Specifically, in another case wherein the thicknesses of the films 232 and 233 are made to be different from each other, it might be necessary to adjust the depth of the etching and/or to increase the number of parts, components, etc., which construct the films 232 and 233. In contrast, in the case of making the length in the X direction of the films 232 and 233 to be different from each other, as in the second embodiment, it is sufficient to adjust only the length of the etching, which is easier as compared with another case of adjusting the depth of etching, and there is also no need to increase the number of the parts, components, etc.

Further, for example, in the second embodiment, the film 234 corresponds to the "first film", and the film 231 corresponds to the "second film". Here, in a case that the compliance of the film 234 and the compliance of the film 231 are compared, although the lengths in the Y direction and the lengths in the Z direction of the film 234 are same as those of the film 231, respectively, the length in the X direction of the film 234 is smaller than the length in the X direction of the film 231, thus the compliance of the film 234 is smaller than the compliance of the film 231.

According to the second embodiment, in a case that the compliance of the film 234 and the compliance of the film 231 are made to be different from each other, the production or manufacture thereof is easier and it is possible to suppress any increase in the number of parts, components, etc., as compared with another case wherein the lengths in the Z direction (thicknesses) of the films 234 and 231 are made to be different from each other. Specifically, in another case wherein the thicknesses of the films 234 and 231 are made to be different from each other, it might be necessary to adjust the depth of the etching and/or to increase the number of parts, components, etc., which construct the films 234 and 231. In contrast, in the case of making the length in the X direction of the films 234 and 231 to be different from each other, as in the second embodiment, it is sufficient to adjust only the length of the etching, which is easier as compared with another case of adjusting the depth of etching, and there is also no need to increase the number of the parts, components, etc.

Third Embodiment

Figure 6:
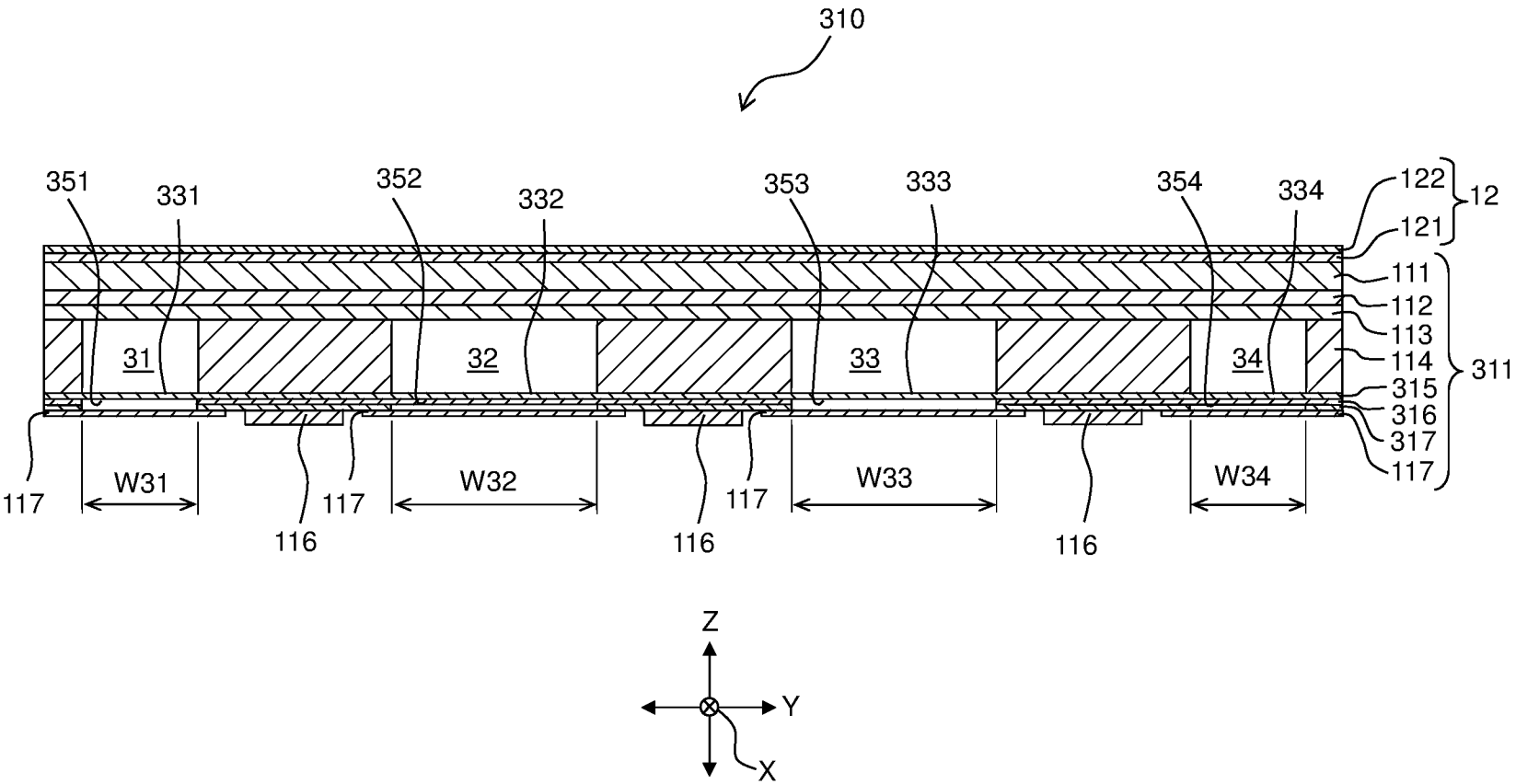
FIG. 6 is a plane view of a head according to a third embodiment, corresponding to FIG. 4.

Next, a head 310 according to a third embodiment of the present disclosure will be explained, with reference to FIG. 6.

In the first embodiment (FIG. 4), the films 131 to 134 have the lengths in the Z direction (thicknesses) which are same as one another. In contrast, in the third embodiment, length in the Z direction (thickness) of a film 332 and length in the Z direction (thickness) of a film 333 are different from each other; and length in the Z direction (thickness) of a film 334 and length in the Z direction (thickness) of a film 331 are different from each other.

Lengths in Y direction of the films 332 and 333 are same as each other, and lengths in Y direction of the films 334 and 331 are same as each other. The length in the Y direction of the film 332 is equal to the width W32 of the common channel 32. The length in the Y direction of the film 333 is equal to the width W33 of the common channel 33 (W32=W33). The length in the Y direction of the film 334 is equal to the width W34 of the common channel 34. The length in the Y direction of the film 331 is equal to the width W31 of the common channel 31 (W31=W34).

A channel member 311 of the third embodiment has a configuration wherein the plate 115 in the channel member 11 of the first embodiment is replaced by three plates 315 to 317. The three plates 315 to 317 are stacked in the Z direction and construct a "film member". Among the three plates 315 to 317, the plate 315 arranged on the uppermost side is not provided with any through hole. The plate 316 which is arranged between the plates 315 and 317 in the Z direction has two through holes formed in parts, of the plate 316, overlapping with the common channels 31 and 34, respectively, in the Z direction. Among the three plates 315 to 317, the plate 317 which is arranged on the lowermost side have four through holes formed in parts, of the plate 317, overlapping with the common channels 31 to 34, respectively, in the Z direction.

The through holes formed in the plates 316 and 317, respectively, and overlapping with the common channel 31 in the Z direction correspond to a recess 351. The through hole formed in the plate 317 and overlapping with the common channel 32 in the Z direction corresponds to a recess 352. The through holes formed in the plates 316 and 317, respectively, and overlapping with the common channel 33 in the Z direction correspond to a recess 353. The through hole formed in the plate 317 and overlapping with the common channel 34 in the Z direction corresponds to a recess 354.

The film 331 is a part, in the plate 315, overlapping with the common channel 31 in the Z direction. The film 332 is parts, in the plates 315 and 316, respectively, overlapping with the common channel 32 in the Z direction. The film 333 is a part, in the plate 315, overlapping with the common channel 33 in the Z direction. The film 334 is parts, in the plates 315 and 316, respectively, overlapping with the common channel 34 in the Z direction.

The thicknesses of the films 331 and 333 are equal to the thickness of one plate 315. The thicknesses of the films 332 and 334 are equal to the thickness of two plates 315 and 316.

Note that a lower end part of the channel 23 (see FIG. 3) is formed in the plates 315 to 317, in a similar manner as in the plate 115.

Three plates 116 are adhered to the lower surface of the plate 317.

Four plates 117 are adhered to the lower surface of the plate 317 so that the four plates 117 cover the four recesses 351 to 354, respectively. With this, the films 331 to 334 are not exposed, and spaces are defined between the respective films 331 to 334 and the respective plates 317, respectively.

In the third embodiment, the lengths in the Z direction (thicknesses) of the recesses 351 and 353 are same as each other, and are equal to the thicknesses of the two plates 316 and 317. The lengths in the Z direction (thicknesses) of the recesses 352 and 354 are same as each other, and are equal to the thickness of the one plate 317. The lengths in the Z direction (thicknesses) of the recesses 351 and 353 are greater than the lengths in the Z direction (thicknesses) of the recesses 352 and 354.

For example, in the third embodiment, the film 332 corresponds to a "first film", the film 333 corresponds to a "second film". Here, in a case that the compliance of the film 332 and the compliance of the film 333 are compared, although the lengths in the X direction and the lengths in the Y direction of the film 332 are same as those of the film 333, the length in the Z direction (thickness) of the film 332 is greater than the length in the Z direction (thickness) of the film 333, thus the compliance of the film 332 is smaller than the compliance of the film 333.

According to the third embodiment, the length in the Z direction (thickness) of the film 332 and the length in the Z direction (thickness) of the film 333 are different from each other. In this case, it is possible to make the elastic compliances of the films 332 and 333 to be different from each other, even without making the lengths in the Y direction (widths) and the lengths in the X direction of the film 332 to be different from those of the film 333.

Further, for example, in the third embodiment, the film 334 corresponds to the "first film", the film 331 corresponds to the "second film". Here, in a case that the compliance of the film 334 and the compliance of the film 331 are compared, although the lengths in the X direction and the lengths in the Y direction of the film 334 are same as those of the film 331, the length in the Z direction (thickness) of the film 334 is greater than the length in the Z direction (thickness) of the film 331, thus the compliance of the film 334 is smaller than the compliance of the film 331.

According to the third embodiment, the length in the Z direction (thickness) of the film 334 and the length in the Z direction (thickness) of the film 331 are different from each other. In this case, it is possible to make the elastic compliances of the films 334 and 331 to be different from each other, even without making the lengths in the Y direction (widths) and the lengths in the X direction of the film 334 to be different from those of the film 331.

Fourth Embodiment

Next, a head 410 according to a fourth embodiment of the present disclosure will be explained, with reference to FIGS. 7 and 8.

In the fourth embodiment, the channel member 11 further has supports 91 to 93. The supports 91 to 93 are arranged in recesses 451 to 454, as depicted in FIG. 8, and support the films 431 to 434. The films 431 and 434 are sandwiched in the Z direction between the supports 91 to 93 and the common channels 31 to 34. Each of the supports 91 to 93 has an upper end fixed to one of the films 431 and 434 and a lower end fixed to the plate 117.

Lengths in Y direction of the films 432, 433 (recesses 452, 453) are same as each other, and lengths in Y direction of the films 434 and 431 (recesses 454 and 451) are same as each other. The length in the Y direction of the film 432 (recess 452) is equal to the width W32 of the common channel 32. The length in the Y direction of the film 433 (recess 453) is equal to the width W33 of the common channel 33 (W32=W33). The length in the Y direction of the film 434 (recess 454) is equal to the width W34 of the common channel 34. The length in the Y direction of the film 431 (recess 451) is equal to the width W31 of the common channel 31 (W31=W34).

The films 431 to 434 (recesses 451 to 454) are coincident with the common channels 31 to 34, respectively, in the Z direction. Namely, the films 431 to 434 (recesses 451 to 454) entirely overlap with the common channels 31 to 34, respectively, in the Z direction, and do not have parts or portions which do not overlap with the common channels 31 to 34, respectively, in the Z direction.

Figure 7:
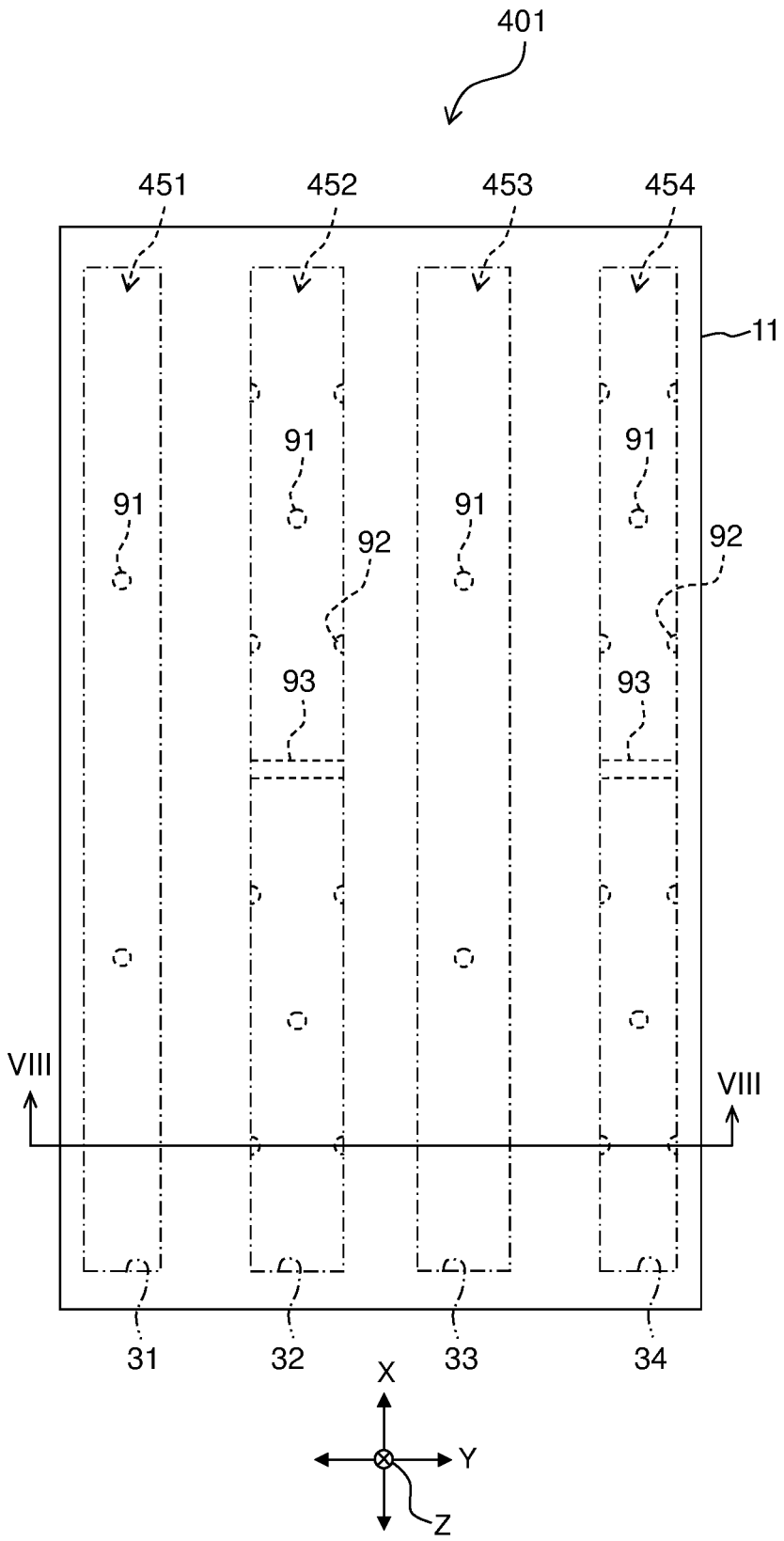
FIG. 7 is a plane view of a head according to a fourth embodiment, corresponding to FIG. 2.
Figure 8:
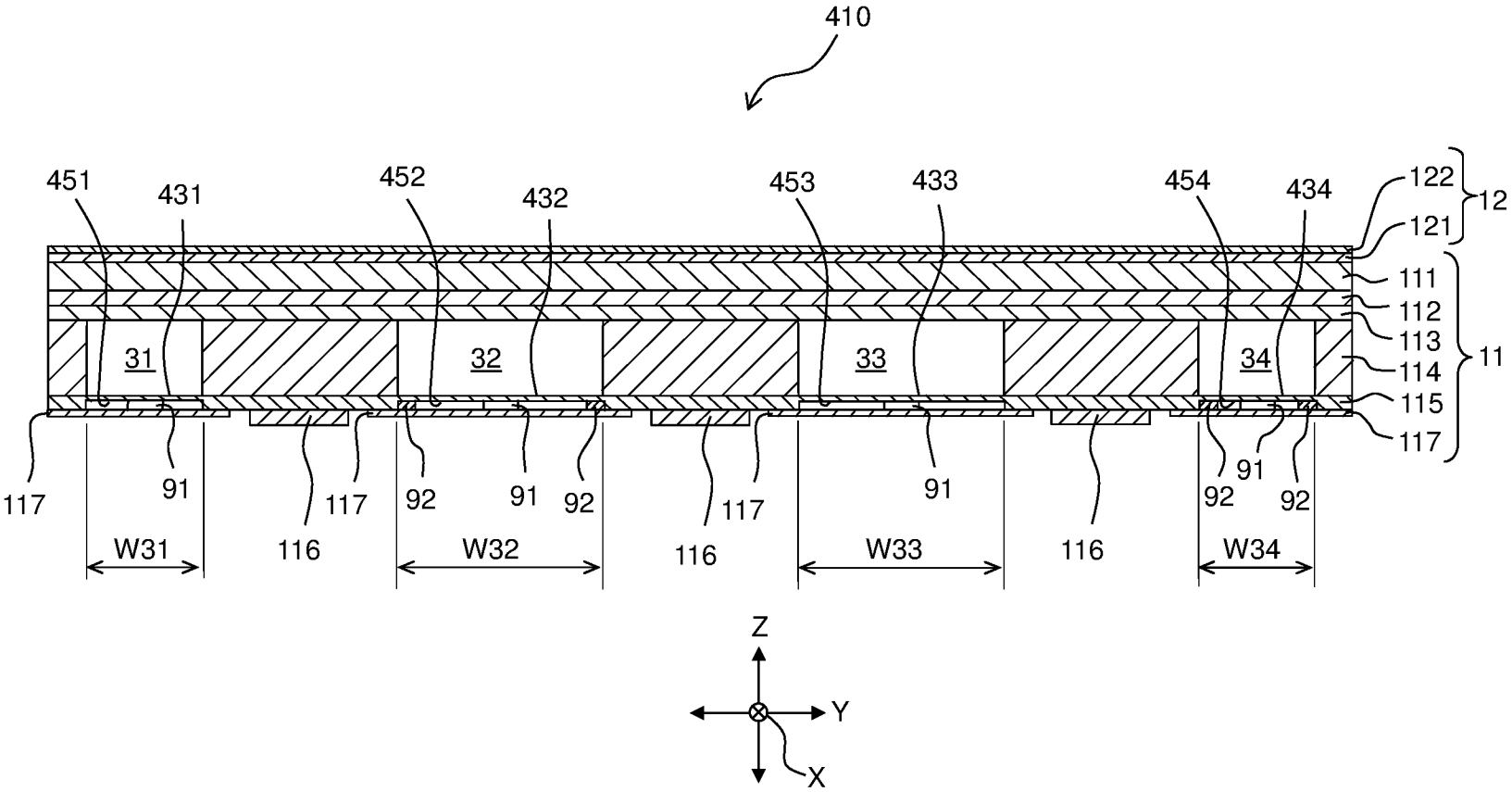
FIG. 8 is a cross-sectional view of the head, along a VIII-VIII line in FIG. 7.

As depicted in FIG. 7, two pieces of the support 91 are provided on each of the recesses 451 and 453. Two pieces of the support 91, eight pieces of the support 92 and one piece of the support 93 are provided on each of the recesses 452 and 454.

Each of the supports 91 has a columnar shape extending in the Z direction, and the supports 91 are positioned at the center in the Y direction of each of the recesses 451 to 454. In each of the recesses 451 to 454, the two supports 91 are apart from each other in the X direction.

Each of the supports 92 has a semi-columnar shape extending in the Z direction, and the supports 92 are positioned at one end and the other end in the Y direction of each of the recesses 452 and 454. As depicted in FIG. 8, each of the supports 92 projects in the Y direction from a side wall, in the plate 115, which defines one of the recesses 452 and 454.

Each of the supports 93 has a plate-like shape extending in the Z direction and Y direction, and the supports 93 are positioned at the center in the X direction of the recesses 452 and 454, respectively. Each of the supports 93 comparts, in the X direction, a space defined between one of the film 432 and the film 434 and one of the plates 117.

For example, in the fourth embodiment, the film 432 corresponds to a "first film", and the film 433 corresponds to a "second film". Here, in a case that the compliance of the film 432 and the compliance of the film 433 are compared, although the lengths in the X direction, the lengths in the Y direction and the lengths in the Z direction of the film 432 are same as those of the film 433, the number of the support provided with respect to the film 432 is greater than the number of the support provided with respect to the film 433, thus the compliance of the film 432 is smaller than the compliance of the film 433.

Further, for example, in the fourth embodiment, the film 434 corresponds to the "first film", and the film 431 corresponds to the "second film". Here, in a case that the compliance of the film 434 and the compliance of the film 431 are compared, although the lengths in the X direction, the lengths in the Y direction and the lengths in the Z direction of the film 434 are same as those of the film 431, the number of the support provided with respect to the film 434 is greater than the number of the support provided with respect to the film 431, thus the compliance of the film 434 is smaller than the compliance of the film 431.

According to the fourth embodiment, it is possible to easily make the elastic compliances of the films 432 and 434 to be small, by providing the supports 91 to 93 and further by making the numbers of the supports 91 to 93 to be different.

Fifth Embodiment

Figure 9:
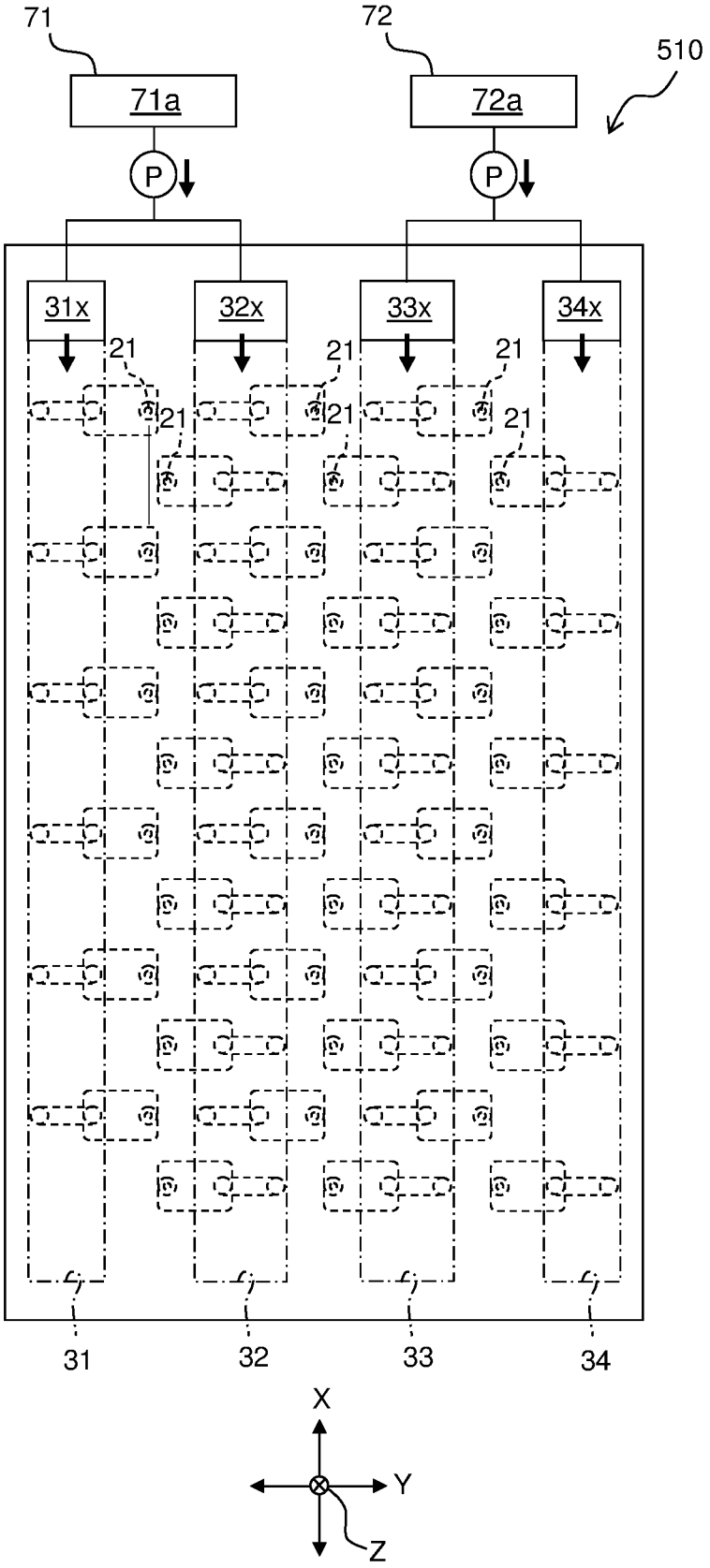
FIG. 9 is a cross-sectional view of a head according to a fifth embodiment, corresponding to FIG. 2.

Next, a head 510 according to a fifth embodiment of the present disclosure will be explained, with reference to FIG. 9.

In the first embodiment (FIG. 2), the common channels 31 to 34 communicate with the storing chamber 70*a* of the same cartridge 70. In contrast, in the fifth embodiment (FIG. 9), the common channels 31 and 32 communicate with a storing chamber 71*a* of a same cartridge 71, and the common channels 33 and 34 communicate with a storing chamber 72*a* of a same cartridge 72. Namely, the common channels 31 and 32 and the common channels 33 and 34 communicate with the different storing chambers, respectively.

A same kind of the ink (for example, a black ink) is stored in the storing chambers 71*a* and 72*a*. The storing chamber 71*a* corresponds to a "first storing chamber", and the storing chamber 72*a* corresponds to a "second storing chamber", and the ink corresponds to a "first liquid". Pumps P are arranged between the openings 31*x* and 32*x* and the storing chamber 71*a* and between the openings 33*x* and 34*x* and the storing chamber 72*a*, respectively. In a case that the respective pumps P are driven by control performed by the controller 5 (see FIG. 1), the ink inside the storing chamber 71*a* is supplied to the common channels 31 and 32, and the ink inside the storing chamber 72*a* is supplied to the common channels 33 and 34.

According to the fifth embodiment, the kind of the liquid to be discharged is same between the nozzles 21 communicating with the common channel 32 and the nozzles 21 communicating with the common channels 33. In this case, if the characteristic periods of the common channels 32 and 33 are same as each other, the unevenness (non-uniformity) in density might be conspicuous. By applying the present disclosure to such a case, it is possible to obtain the effect of the present disclosure (effect of suppressing the unevenness in the density) effectively and practically.

According to the fifth embodiment, the kind of the liquid to be discharged is same between the nozzles 21 communicating with the common channel 34 and the nozzles 21 communicating with the common channels 31. In this case, if the characteristic periods of the common channels 34 and 31 are same as each other, the unevenness (non-uniformity) in density might be conspicuous. By applying the present disclosure to such a case, it is possible to obtain the effect of the present disclosure (effect of suppressing the unevenness in the density) effectively and practically.

Modified Embodiments

In the foregoing, the embodiments of the present disclosure have been explained. The present disclosure, however, is not limited to or restricted by the above-described embodiments; it is allowable to make a various kind of design changes to the present disclosure, within the scope described in the claims.

The volume of the first common channel and the volume of the second common channel are not limited to or restricted by being same as each other, and may be different from each other.

In the above-described embodiments, the length in the first direction of the first common channel and the length in the first direction of the second common channel are same as each other. The present disclosure, however, is not limited to this. In the second aspect of the present disclosure, it is allowable that the length in the first direction of the first common channel and the length in the first direction of the second common channel are substantially same as each other (namely, a difference to an extent, for example, of approximately 3 mm may be present between the former and the latter, or the difference therebetween may be not more than 10% of a longer one of the former and the latter). In the first aspect of the present disclosure, the length in the first direction of the first common channel and the length in the first direction of the second common channel may be different from each other.

In the above-described embodiments, although the number of the plurality of first nozzles (namely, the number of the nozzle communicating with the first common channel) and the number of the plurality of second nozzles (namely, the number of the nozzle communicating with the second common channel) are same as each other, the number of the plurality of first nozzles and the number of the plurality of second nozzles may be different from each other (for example, a difference to an extent of several pieces is allowable therebetween).

The configurations of the above-described respective embodiments may be combined. For example, in the second embodiment (FIG. 5), not only the lengths in the first direction of the first and second films, but also the lengths in the second or third direction of the first and second films may be made to be different from each other. In the third embodiment (FIG. 6), not only the lengths in the third direction of the first and second films, but also the lengths in the first or second direction of the first and second films may be made to be different from each other. In a configuration in which the lengths in the first, second or third direction of the first and second films are made to be different from each other, it is allowable to provide the supports in the fourth embodiment (FIGS. 7 and 8).

The second support is not limited to being plural, and may be provided as one second member. In a case that the second support is not provided, the first support is not limited to being plural, and may be provided as one first member.

In the above-described embodiments, the plates are provided at the outside of the films, and the films are not exposed. However, the films may be exposed.

The arrangement of the nozzles is not limited to that in the above-described embodiments. For example, in the first embodiment (FIG. 2), although the two nozzle rows R3 and R4 are arranged, in the Y direction, between the common channel 32 and the common channel 33, it is allowable that one nozzle row is arranged, in the Y direction, between the common channel 32 and the common channel 33. Further, in the first embodiment (FIG. 2), although the two nozzle rows R2 and R3 are arranged with respect to the common channel 32 and the two nozzle rows R4 and R5 are arranged with respect to the common channel 33, it is allowable that one nozzle row is arranged with respect to each of the common channels 32 and 33.

The liquid discharged (dischargeable) from the nozzles is not limited to being the ink; it is allowable that the liquid is any liquid (for example, a treating liquid causing a component in the ink to aggregate or deposit; etc.).

The actuator is not limited to the piezoelectric system using the piezoelectric element, and may be of another system (for example, the thermal system using heating elements, an electrostatic system using the electrostatic force, etc.).

The liquid discharge head is not limited to being of the line system, and may be of the serial system.

The present disclosure is not limited to being applicable to the printer; the present disclosure is applicable also to a facsimile machine, copying machine, a multifunction peripheral, etc. Further, the present disclosure is also applicable to a liquid discharge apparatus usable for a usage different from recording of an image (for example, a liquid discharge apparatus configured to discharge a conductive liquid onto a substrate so as to form a conductive pattern), etc.

What is claimed is:

1. A liquid discharge head comprising:

a channel member including:

a nozzle surface in which a plurality of first nozzles aligned in a first direction, and a plurality of second nozzles aligned in the first direction and arranged side by side to the plurality of first nozzles in a second direction orthogonal to the first direction are opened;

a first common channel extending in the first direction and communicating with the plurality of first nozzles;

a second common channel extending in the first direction, arranged side by side to the first common channel in the second direction, and communicating with the plurality of second nozzles; and a film member including a first surface and a second surface, the first surface defining the first common channel and the second common channel, being parallel to the first and second directions, the second surface being located an opposite side to the first surface in a third direction orthogonal to the first and second directions, and being parallel to the first and second directions, wherein the second surface includes a first recess overlapping with the first common channel in the third direction, and a second recess overlapping with the second common channel in the third direction, wherein a length of the first recess in the second direction is different from a length of the second recess in the second direction, and wherein a length of the first common channel in the second direction is same as a length of the second common channel in the second direction.

2. The liquid discharge head according to claim 1, wherein the length in the second direction of the second recess is longer than the length of the first recess in the second direction, and is longer than a length of the second common channel in the second direction.

3. The liquid discharge head according to claim 1, wherein a length of the second recess in the first direction is longer than a length of the first recess in the first direction, and is longer than a length of the second common channel in the first direction.

4. The liquid discharge head according to claim 1, wherein the channel member includes a first support supporting the film member, and wherein the film member is positioned between the first common channel and the first support in the third direction.

5. The liquid discharge head according to claim 4, wherein the first support is one of a plurality of first supports, wherein the channel member further includes:

the plurality of first supports; and at least one second support supporting the film member, the film member being sandwiched between the at least one second support and the second common channel in the third direction, and wherein a number of the plurality of first supports is greater than the number of the at least one second support.

6. The liquid discharge head according to claim 1, wherein a length of the first common channel in the first direction is same as a length of the second common channel in the first direction.

7. The liquid discharge head according to claim 1, wherein a length of the first common channel in a third direction orthogonal to the first and second directions is same as a length of the second common channel in the third direction.

8. The liquid discharge head according to claim 1, wherein the plurality of first nozzles and the plurality of second nozzles are positioned between the first common channel and the second common channel in the second direction.

9. The liquid discharge head according to claim 1, wherein the plurality of first nozzles forms a first nozzle row and a second nozzle row arranged side by side in the second direction, wherein the plurality of second nozzles forms a third nozzle row and a fourth nozzle row arranged side by side in the second direction, wherein the second nozzle row and the third nozzle row are positioned between the first nozzle row and the fourth nozzle row in the second direction, and wherein a spacing distance between the second nozzle row and the third nozzle row in the second direction is smaller than any one of a spacing distance between the first nozzle row and the second nozzle row in the second direction, and a spacing distance between the third nozzle row and the fourth nozzle row in the second direction.

10. The liquid discharge head according to claim 1, wherein the first common channel communicates with a first storing chamber configured to store a first liquid, and wherein the second common channel communicates with the first storing chamber.

11. The liquid discharge head according to claim 1, wherein the first common channel communicates with a first storing chamber configured to store a first liquid, and wherein the second common channel communicates with a second storing chamber configured to store a second liquid of which kind is same as that of the first liquid.

12. A liquid discharge head comprising:

a channel member including:

a nozzle surface in which a plurality of first nozzles aligned in a first direction, and a plurality of second nozzles aligned in the first direction and arranged side by side to the plurality of first nozzles in a second direction orthogonal to the first direction are opened;

a first common channel extending in the first direction and communicating with the plurality of first nozzles;

a second common channel extending in the first direction, arranged side by side to the first common channel in the second direction, and communicating with the plurality of second nozzles;

a first film defining the first common channel; and a second film defining the second common channel, wherein a length of the first common channel in the first direction is same as a length of the second common channel in the first direction, and wherein an elastic compliance of the first film is different from an elastic compliance of the second film.

13. The liquid discharge head according to claim 12, wherein a length of the first film in the second direction is different from a length of the second film in the second direction.

14. The liquid discharge head according to claim 12, wherein a length of the first film in the first direction is different from a length of the second film in the first direction.

15. The liquid discharge head according to claim 12, wherein a length of the first film in a third direction orthogonal to the first and second directions is different from a length of the second film in the third direction.

16. The liquid discharge head according to claim 12, wherein the elastic compliance of the first film is smaller than the elastic compliance of the second film, wherein the channel member further includes a first support supporting the first film, and wherein the first film is positioned between the first common channel and the first support in a third direction orthogonal to the first and second directions.

17. The liquid discharge head according to claim 16, wherein the first support is one of a plurality of first supports, wherein the channel member further includes the plurality of first supports, and at least one second support supporting the second film, wherein the second film is positioned between the second common channel and the at least one second support in the third direction, and wherein a number of the plurality of first supports is greater than a number of the at least one second support.

18. The liquid discharge head according to claim 12, wherein a length of the first common channel in the second direction is same as a length of the second common channel in the second direction.

19. The liquid discharge head according to claim 12, wherein a length of the first common channel in a third direction orthogonal to the first and second directions is same as a length of the second common channel in the third direction.

20. The liquid discharge head according to claim 12, wherein the plurality of first nozzles and the plurality of second nozzles are arranged between the first common channel and the second common channel in the second direction.

21. The liquid discharge head according to claim 12, wherein the plurality of first nozzles forms a first nozzle row and a second nozzle row arranged side by side in the second direction, wherein the plurality of second nozzles forms a third nozzle row and a fourth nozzle row arranged side by side in the second direction, wherein the second nozzle row and the third nozzle row are positioned between the first nozzle row and the fourth nozzle row in the second direction, wherein a spacing distance between the second nozzle row and the third nozzle row in the second direction is smaller than any one of a spacing distance between the first nozzle row and the second nozzle row in the second direction, and a spacing distance between the third nozzle row and the fourth nozzle row in the second direction.

22. The liquid discharge head according to claim 12, wherein the first common channel communicates with a first storing chamber configured to store a first liquid, and wherein the second common channel communicates with the first storing chamber.

23. The liquid discharge head according to claim 12, wherein the first common channel communicates with a first storing chamber configured to store a first liquid, and wherein the second common channel communicates with a second storing chamber configured to store a second liquid of which kind is same as that of the first liquid.

* * * * *